US005852392A

United States Patent [19]

Aharonian

[11] Patent Number: 5,852,392

[45] Date of Patent: Dec. 22, 1998

[54] ELECTROMAGNETIC RELAY

[75] Inventor: Hrair N. Aharonian, Westland, Mich.

[73] Assignee: Letra, Inc., Canton, Mich.

[21] Appl. No.: 568,695

[22] Filed: Dec. 7, 1995

[51] Int. Cl.[6] ..... H01H 51/22

[52] U.S. Cl. ..... 335/80; 335/78; 335/128

[58] Field of Search ..... 335/78–86, 124, 335/128, 131

[56] References Cited

U.S. PATENT DOCUMENTS

| | | | |
|---|---|---|---|
| 5,216,396 | 6/1993 | Stahly | 335/78 |
| 5,317,294 | 5/1994 | Vielot | 335/80 |
| 5,321,377 | 6/1994 | Aharonian | 335/128 |
| 5,325,079 | 6/1994 | Aharonian | 335/83 |
| 5,455,550 | 10/1995 | Von Alten et al. | 335/80 |

*Primary Examiner*—Lincoln Donovan
*Attorney, Agent, or Firm*—Gifford, Krass, Groh Sprinkle, Patmore, Anderson & Citkowski

[57] ABSTRACT

An electromagnetic relay comprises a frame having a magnetically permeable flat pole face, an electric coil for developing a magnetic flux in said pole face, and an L-shaped armature having a leg portion and a foot extending at substantially a right angle to the leg portion, one end of the leg portion of the armature being pivoted for rotation between a first position wherein both the leg and foot portions of the armature extend at acute angles to the flat pole face of the frame and a second position wherein the foot portion of the armature lies in close parallel relation to the pole face on the frame and the leg portion of the armature extends at a right angle to the pole face on the frame.

1 Claim, 3 Drawing Sheets

ELECTROMAGNETIC RELAY

BACKGROUND OF THE INVENTION

Conventional electromagnetic relays comprise a magnetically permeable frame or pole, an electric coil for developing a magnetic flux in the frame or pole, and in an air gap between the frame or pole, and an armature that is supported for movement relative to the frame or pole upon electrical energization of the coil. The armature is generally biased by a return spring in a direction opposite to the direction of movement thereof due to energization of the coil.

One shortcoming of known electromagnetic relays is the failure to efficiently utilize the magnetic flux developed by the electromagnetic coil resulting in relatively limited movement of the armature. As a consequence, relatively large, heavy and expensive electromagnetic coils are required.

SUMMARY OF THE INVENTION

In accordance with the present invention, flux developed by the electromagnetic coil of a relay is utilized in a highly efficient manner by employing an L-shaped armature that is pivoted for rotation on a magnetically permeable frame of the relay. The L-shaped armature develops relatively high torque due to the orientation and cooperation of three magnetic flux fields that extend across triangular air gaps.

Specifically, the L-shaped armature and one leg or a U-shaped frame form a triangular or wedge shaped air gap which accommodates a large armature pivot angle.

DETAILED DESCRIPTION OF THE PREFERRED EMBODIMENT(S)

Figure 1:
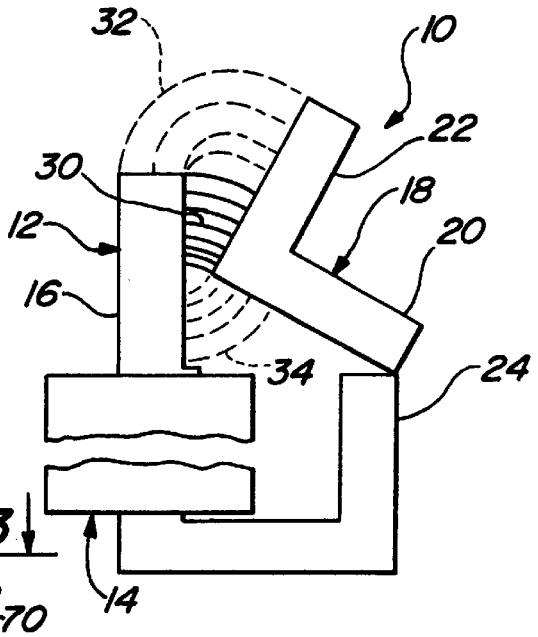
FIG. 1 is a diagrammatic view of the flux field utilized by a relay having an L-shaped armature in accordance with the present invention.

In accordance with the present invention, and as shown diagrammatically in FIG. 1 of the drawings, a relay 10 comprises a U-shaped frame 12 having an electric coil 14 disposed about one leg 16 thereof. An L-shaped armature 18 comprising a leg 20 and foot 22 is pivoted on a leg 24 of the frame 12.

In accordance with the present invention, both the primary flux field, shown in solid lines 30, and a pair of spaced secondary flux fields, shown by dashed lines 32 and 34, are utilized by the L-shaped configuration of the armature 18. The secondary flux fields, identified by the lines 32 and 34, are tangentially related to the pivot point of the armature 18 on the frame 12, materially increasing torque operative on the armature 18.

Figure 2:
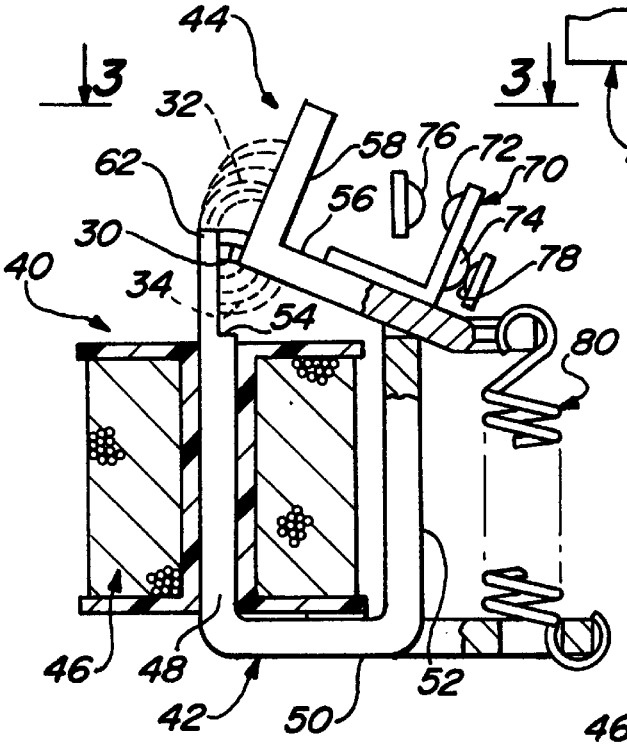
FIG. 2 is an elevational view of a relay in accordance with one embodiment of the present invention.
Figure 3:
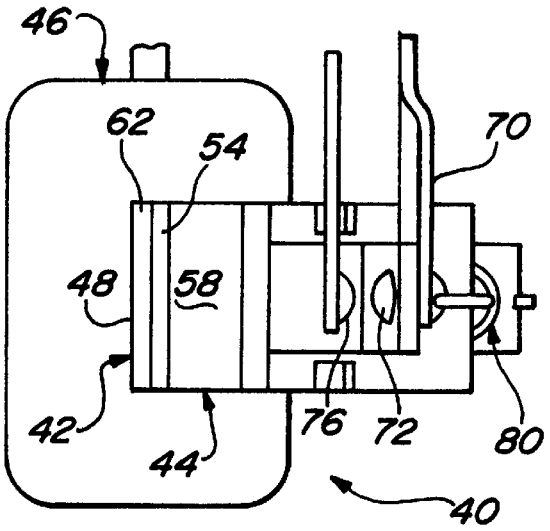
FIG. 3 is a view taken in the direction of the arrow "3" of FIG. 2.

As seen in FIG. 2, the aforesaid geometry is embodied in an electromagnetic relay 40 which comprises a U-shaped frame 42, an L-shaped armature 44, and a coil 46. The frame 42 has a first leg 48, a base 50, and a second leg 52. The coil 46 is disposed about the first leg 48 so as to develop a magnetic flux field in the frame 42 and in an air gap between the frame 42 and armature 44. The first leg 48 has a step therein that defines a seat 54 for the armature 44 and functions as a primary field concentrator as the armature 44 approaches the closed position relative to the frame 42.

The armature 44 comprises a leg 56 and a foot 58. The leg 56 of the armature 44 is pivoted on the leg 52 of the frame 43 for counterclockwise rotation, as seen in FIG. 2, when the coil 46 is energized. The frame 42 and armature 44 are preferably constructed from low carbon steel in accordance with standard principles.

In accordance with the present invention, a primary flux field, shown by solid lines 30, is developed between an upper end 62 of the leg 48 on the frame 42 and the portion of the foot 58 of the armature 44 adjacent the junction of the foot 58 and leg 56 thereof. Secondary flux fields, shown by dotted lines 32 and 34, are developed on opposite sides of the primary flux field 30 so as to maximize the counterclockwise magnetic bias on the armature 44.

The armature 44 has a bracket 70 thereon that supports a pair of moveable contacts 72 and 74 that are engageable with a pair of stationary contacts 76 and 78, respectively, for connection of the relay 40 to external devices (not shown). When the coil 46 is deenergized, a spring 80 biases the armature 44 clockwise to the position shown in FIG. 2 wherein the moveable contact 74 contacts the stationary contact 78, establishing a first electrical circuit with an external device, not shown. When the coil 46 is energized, the armature 44 rotates counterclockwise under a magnetic bias so that the moveable contact 72 contacts the stationary contact 76 establishing a second electrical circuit with an external device. The tension of the spring 80 and the magnitude of the electromagnetic flux developed by the coil 46 is calibrated so as to develop an appropriate contact force between the moveable contacts 72 and 74 and the stationary contacts 76 and 78, respectively.

Figure 4:
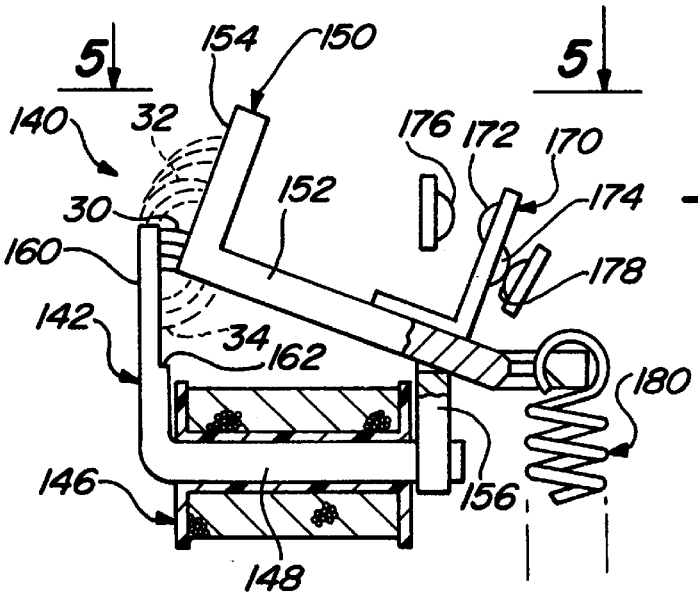
FIG. 4 is a view similar to FIG. 2, of another embodiment of the present invention.
Figure 5:
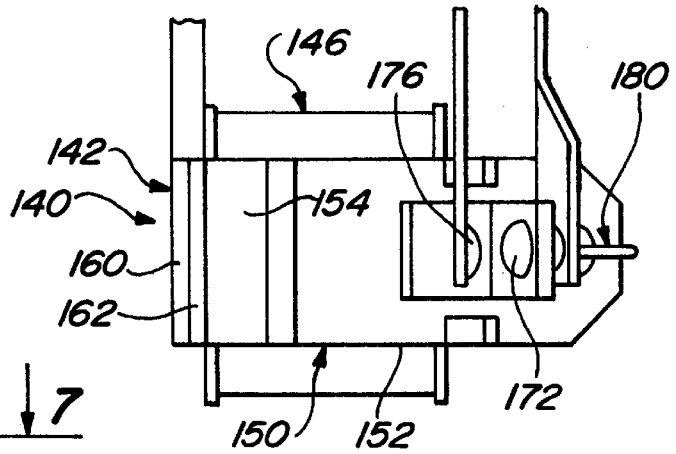
FIG. 5 is a view taken in the direction of the arrow "5" of FIG. 4.

Referring to FIG. 4, a second embodiment of the present invention comprises a relay 140 having a U-shaped frame 142 with an electric coil 146 disposed about a bight portion 148 thereof. An L-shaped armature 150 comprising a leg 152 and foot 154 is pivoted on a leg 156 of the frame 142. The relay 140 utilizes both a primary flux field, shown in solid lines 30, and secondary flux fields, shown by dashed lines 32 and 34, to effect movement of the armature 150. The addition of the secondary flux fields to the conventional primary flux field materially increases the torque operative on the armature 150.

A leg 160 on the frame 142 has a step 162 therein that functions as a seat and flux concentrator for the armature 150 upon rotation thereof to the closed position relative to the frame 142.

The armature 150 has a bracket 170 thereon that supports a pair of moveable contacts 172 and 174. A pair of stationary contacts 176 and 178 mate with the contacts 172 and 174, respectively, for connection of the relay 140 to an external device (not shown).

When the coil 146 is deenergized, a spring 180 biases the armature 150 clockwise so that the moveable contact 174 contacts the stationary contact 178, establishing a first electrical circuit with the external device. When the coil 146 is energized, the armature 150 rotates counterclockwise under the magnetic bias produced in the coil 146 so that the moveable contact 172 contacts the stationary contact 176 establishing a second electrical circuit with an external device. Tension of the spring 180 and the magnitude of the electromagnetic flux developed by the coil 146 are calibrated to develop an appropriate contact force between the moveable contacts 172 and 174 and the stationary contacts 176 and 178, respectively.

Figure 6:
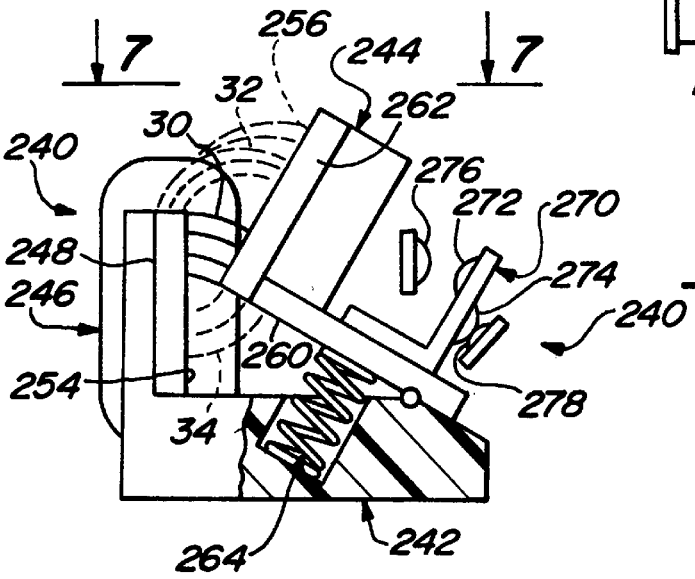
FIG. 6 is an elevational view of another embodiment of the present invention.
Figure 7:
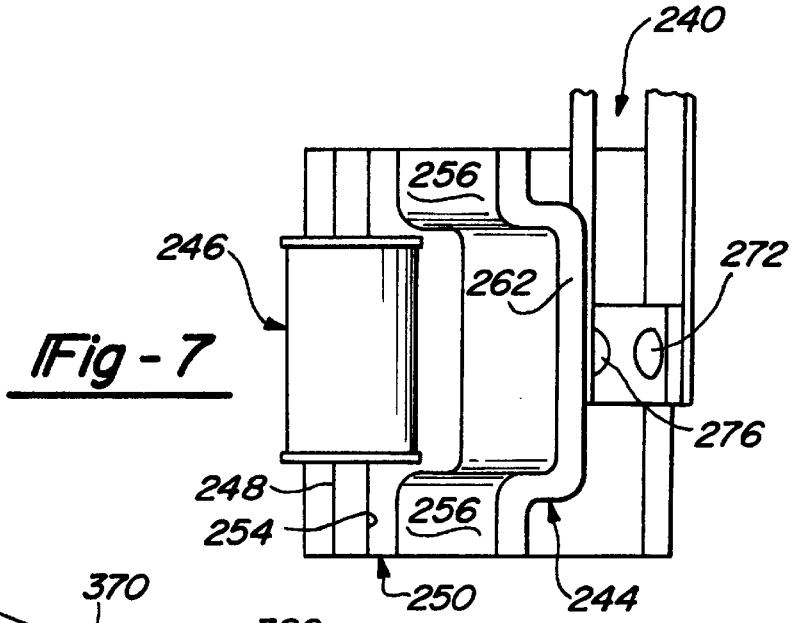
FIG. 7 is a view taken in the direction of the arrow "7" of FIG. 6.

As seen in FIG. 6, yet another embodiment of the invention comprises an electromagnetic relay 240 having a non-magnetic frame 242, an L-shaped armature 244, and a coil 246. The frame 242 has an upstanding magnetic pole piece 248 upon which the coil 246 is mounted so as to develop a magnetic flux circuit therein. The pole piece 248 has a flat face 254 complimentary to spaced faces 256 on the armature 244.

The armature 244 comprises a leg 260 and a foot 262. The leg 260 of the armature 244 is pivoted on the frame 242 for counterclockwise rotation, as seen in FIG. 6, when the coil 246 is energized. The armature 244 is normally biased clockwise by a spring 264.

The armature 244 has a bracket 270 thereon that supports a pair of moveable contacts 272 and 274 that are engageable with a pair of stationary contacts 276 and 278, respectively, for connection of the relay 240 to external devices (not shown).

When the coil 246 is deenergized, the spring 264 biases the armature 244 clockwise so that the moveable contact 274 contacts the stationary contact 278, establishing a first electrical circuit with the external device. When the coil 246 is energized, the armature 244 rotates counterclockwise under a magnetic bias so that the moveable contact 272 contacts the stationary contact 276 establishing a second electrical circuit with an external device and disengaging the first circuit. The spring constant of the spring 264 and the magnitude of the electromagnetic flux in the coil 246 are calibrated to develop an appropriate contact force between the moveable contacts 272 and 274 and the stationary contacts 276 and 278, respectively.

In accordance with the present invention, a primary flux field 30, shown in solid lines, is developed between the face 256 on the foot 262 of the armature 244 and the face 254 on the pole piece 248. Secondary flux fields, shown in dotted lines 32 and 34, are developed on opposite sides of the primary flux field so as to augment the magnetic bias on the armature 244 in a counterclockwise direction upon energization of the coil 246.

Figure 8:
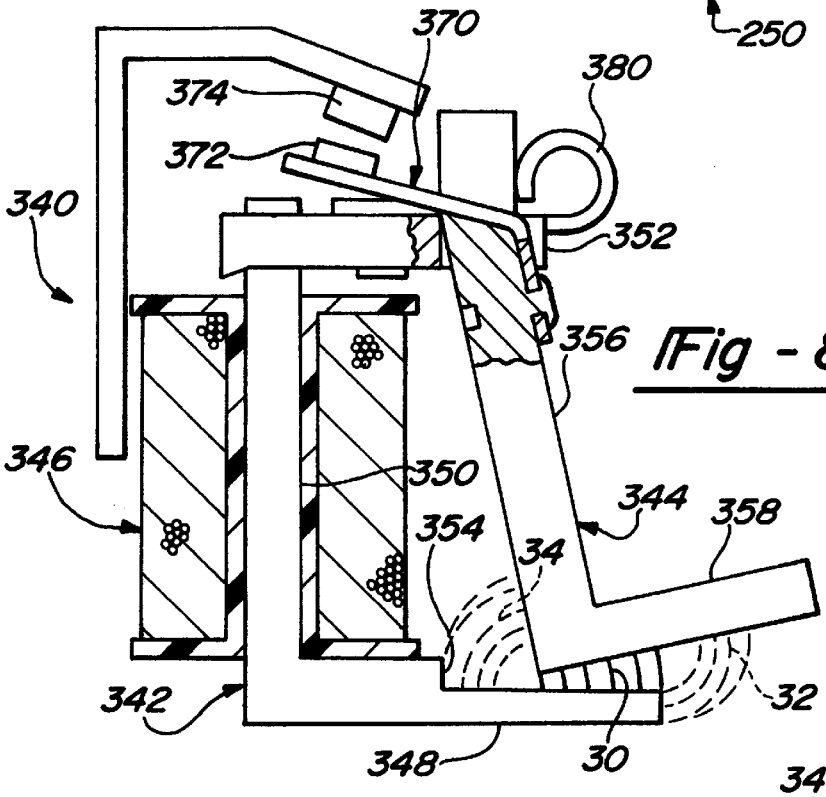
FIG. 8 is a view of yet another embodiment of a relay in accordance with the present invention.

As seen in FIG. 8, yet another embodiment of the invention comprises an electromagnetic relay 340 which comprises a U-shaped frame 342, an L-shaped armature 344, and a coil 346. The frame 342 has a first leg 348, a bight portion 350, and a second leg 352. The coil 346 is disposed about the bight portion 350 of the frame 342 so as to develop a magnetic flux field therein. The first leg 348 has a step 354 therein that functions as a seat and flux concentrator for the armature 344 upon rotation thereof to the closed position relative to the frame 342.

The armature 344 comprises a leg 356 and a foot 358. The leg 356 of the armature 344 is pivoted on the leg 352 of the frame 342 for clockwise rotation, as seen in FIG. 8, when the coil 346 is energized.

The armature 344 has a bracket 370 thereon that supports a moveable contact 372 which is engageable with a stationary contact 374 for connection of the relay 340 to an external device (not shown).

When the coil 346 is deenergized, a spring 380 biases the armature 344 counterclockwise so that the moveable contact 372 is disengaged from the stationary contact 374. When the coil 346 is energized, the armature 344 rotates clockwise under the magnetic bias produced by the coil 346 so that the moveable contact 372 contacts the stationary contact 374 establishing an electrical circuit with an external device. The tension of the spring 380 and the magnitude of the electromagnetic flux developed by the coil 346 is calibrated so as to develop appropriate contact pressure between the moveable contact 372 and the stationary contact 374.

In accordance with the present invention, a primary flux field, shown by solid lines 30, is developed between the leg 348 on the frame 342 and the portion of the foot 358 of the armature 344 adjacent the junction of the foot 358 and leg 356 thereof. Secondary flux lines, shown by dotted lines 32 and 34, are developed on opposite sides of the primary flux field which augment the magnetic bias on the armature 344 due to the electromagnetic force created by the energization of the coil 346.

Figure 9:
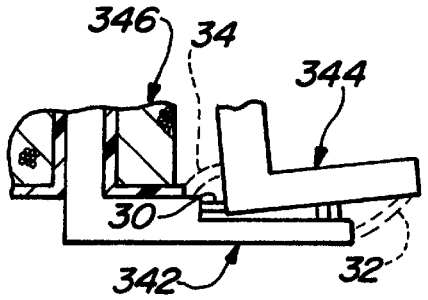
FIG. 9 is a fragmentary view showing the armature of FIG. 8 after rotation into close proximity to the relay frame.

As seen in FIG. 9, the primary flux field designated by the lines 30 shifts 90° as the armature 344 approaches the step 354 in the frame 342 thereby augmenting the secondary flux field 34 and maximizing torque on the armature 344.

While the preferred embodiment of the invention has been disclosed, it should be appreciated that the invention is susceptible of modification without departing from the scope of the following claims.

I claim:

1. An electromagnetic relay comprising a generally U-shaped magnetically permeable frame comprising first and second spaced legs connected by a bight portion;

an electromagnetic coil disposed about said frame developing a magnetic flux therein of opposite polarity in the legs thereof, respectively, first and second flat pole faces of like polarity on the first leg of said frame extending at a right angle to one another; and an L-shaped armature comprising a leg portion having a foot portion at one end thereof extending at a right angle to the leg portion, the opposite end of the leg portion of said armature being pivoted on the second leg of said frame with the axis of rotation thereof lying in the plane of the first pole face on the first leg of said frame and extending parallel to the second pole face therein, said armature being rotatable between a first position wherein both the leg and foot portions thereof extend at acute angles to the first and second pole faces, respectively, on the first leg of said frame and a second position wherein the foot portion of said armature lies in close juxtaposed relation to the second pole face on the first leg of said frame and the leg portion of said armature is engaged with the first pole face on the first leg of said frame to maximize magnetic flux efficiency and to preclude jamming of the foot portion of said armature against the second pole face.

* * * * *